US005322453A

United States Patent [19]

Resnick et al.

[11] Patent Number: 5,322,453

[45] Date of Patent: Jun. 21, 1994

[54] RF CONNECTOR JACK AND PLUG ASSEMBLY

[75] Inventors: Paul Resnick, Boxborough, Mass.; Francis Wilson, Oxford, Conn.

[73] Assignee: M/A-COM Omni Spectra, Inc., Merrimack, N.H.

[21] Appl. No.: 981,265

[22] Filed: Nov. 25, 1992

[51] Int. Cl.[5] ..... H01R 17/04

[52] U.S. Cl. ..... 439/581; 439/63

[58] Field of Search ..... 439/578-585, 439/675, 63, 394, 736

[56] References Cited

U.S. PATENT DOCUMENTS

| | | | |
|---|---|---|---|
| 3,893,743 | 7/1975 | Wallo | 439/578 |
| 4,759,722 | 7/1988 | Song | 439/578 |
| 4,904,206 | 2/1990 | Laudig et al. | 439/578 |

*Primary Examiner*—David Pirlot

*Attorney, Agent, or Firm*—Hayes, Soloway, Hennessey, Grossman & Hage

[57] ABSTRACT

An RF jack and plug assembly provides 360° of contact with a strong mechanical bond between the two parts. The jack has molded and stamped interrelated parts that predeterminedly position the parts for simple and accurate assembly. The construction provides positive electrical contact and long life for the contact elements with complete RF shielding.

3 Claims, 2 Drawing Sheets

RF CONNECTOR JACK AND PLUG ASSEMBLY

FIELD OF THE INVENTION

The present invention generally relates to an RF connector and more particularly, to a surface mounted plug type connector to be used for connecting various electrical parts to a circuit board and a jack for use therewith.

BACKGROUND OF THE INVENTION

The RF connector jack assembly which is the preferred embodiment of the present invention is a miniature device designed to allow a coaxial cable to interconnect from one printed circuit board to another or to an external device. This is accomplished by interconnecting the jack to a mating plug which mounts on a printed circuit board. An RF signal can then be transmitted from the board to another board via the coaxial cable. The RF connector jack sub-assembly consists of an outer housing/contact, a dielectric support, and an inner contact. This sub-assembly is then terminated to a coaxial cable to form the final connector jack assembly. An example of one such subassembly and corresponding plug assembly is illustrated in U.S. Pat. No. 5,078,621 issued Jan. 7, 1992 to Nishi Kawa et al.

BRIEF DESCRIPTION OF THE INVENTION

The present invention is directed to several important improvements in the construction of plug and jack assemblies of the type illustrated in the above '621 patent. In particular, the plug design provides 360° of contact between the outer housing on the jack and the outer contact on the plug. This provides better shielding, improved electrical contact and more rugged mechanical connection between the plug and jack.

With respect to the jack, certain details of the dielectric support provide positive orientation and fixation of the inner contact elements of the jack assembly. The unique component orientation and captivation features designed into the jack assembly have several advantages. They are inherently fool proof as they do not rely on a secondary forming operation and they do not interfere in any way with the full required flexing of the inner and outer contact spring fingers. This ensures proper and consistent spring force during mating and operation.

The above improved results are obtained by use of several cooperating features of the novel design. For example, the inner cylindrical outer connection in the plug forms a 360° contact surface with an outwardly flared surface adjacent its upper end to receive the jack. Additionally, the dielectric support element in the jack has a pair of radially extending ears adjacent the top end of the dielectric element and a pair of notches in the outer cylindrical connector for receiving and supporting and locating the ears. Also, there are a pair of grooves in the walls of the inner cylindrical wall of the dielectric support near the top thereof and a pair of outwardly extending tabs carried by the inner connector near the top thereof for engaging the grooves in the dielectric support. Preferably, the exterior wall of the dielectric support in the jack tapers inwardly over most of its length so that the multisectional outer wall of the jack is free of contact with the dielectric support over most of its length to permit beam deflection over an extended length of the wall section on insertion of the jack into the plug.

BRIEF DESCRIPTION OF THE DRAWINGS

In order to more fully understand the invention, reference should be had to the following detailed specification taken in connection with the accompanying drawings wherein.

DETAILED DESCRIPTION OF THE INVENTION

Figure 1:
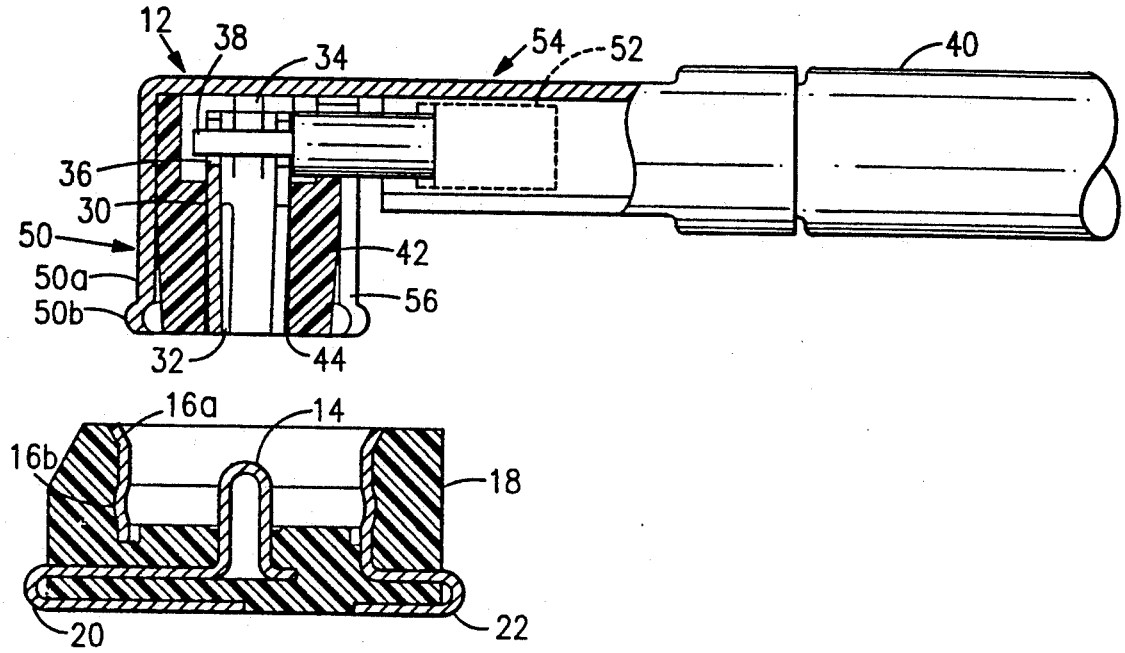
FIG. 1 is a diagramatic schematic sectional view of one preferred embodiment of the invention showing the plug and jack out of engagement.

Referring now to FIG. 1, there is shown a schematic partially sectional view of a plug and jack assembly, the plug being shown at 10 and the jack at 12.

The RF connector plug is an insert molded device consisting of three parts: an inner contact 14, an outer contact 16, and a housing 18.

The inner contact 14 is generally cylindrically shaped but has an integral flat tail 20. The cylindrical portion is blind such that it is completely closed at the top end or end opposite the tail 20. This cylindrical area forms the male center contact of the plug interface area. The tail 20 becomes one of the four leads which solder to the printer circuit board. The tail 20 of the center contact is a portion of the original sheet unformed but cut to the correct final shape.

The outer contact 16 is generally ring shaped with three integral flat tails 22 similar in shape and function to the lead 20 described for the center contact. The three tails 22 also become solder leads for the device. Within the ring shaped area, the outer contact 16 contains a cone shaped area **16*a* near the top of the contact and an undercut groove 16*b* near the bottom of the ring. The cone shaped area 16*a* flairs from the inside diameter of the ring section, increasing in diameter at approximately a 30° angle. This feature allows the mating contact on the jack to be smoothly and gradually inserted since the jack is somewhat larger at its end than the inside diameter of the ring. The undercut groove 16*b*** is an integral feature in the ring area and acts as a retainer between the plug connector and the mating jack.

The housing 18 which supports the inner contact 14 and outer contact 16 is a plastic injection molding and the contacts themselves are insert molded into the plastic 18. The inner and outer contacts are placed into the mold cavity and held in their relative positions while the molten plastic material is injected into the mold. The housing is preferably molded from an engineering thermoplastic resin such as polyphenylene sulfide. When the plastic solidifies, the contacts are permanently locked in and cannot come out or shift in their location.

Figure 2:
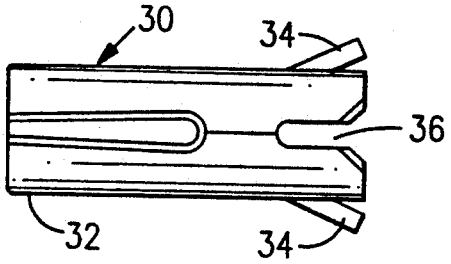
FIG. 2 is a side view of the jack's inner connector.

In the jack assembly 12, an inner contact 30 is generally shaped like a hollow tube with three contact "fingers" 32 at the bottom end of this tube. The fingers 32 are actually cantilever beams which first bend inwardly and then flex outward when the jack 12 is mated with the inner contact 14 in the plug 10. At the top end of the inner contact tube 30 are two tabs 34 (See FIG. 2) located on opposite sides and protruding radially outward. Also located at the top of the contact tube 30 are two slots 36 running axially along the sides of the tube, opposite each other and perpendicular to the two tabs 34. These slots 36 are designed to allow a center conductor 38 of a coaxial cable 40 to be pressed into the center line of the contact 30 thus forming a right angle electrical connection. The inner contact 30 is preferably stamped and formed in progressive die stamping equipment and is preferably made from beryllium copper alloy C17200.

Figure 3A:
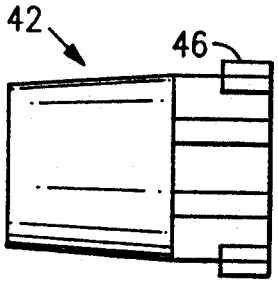
FIGS. 3A, 3B and 3C are side sectional views of the dielectric support for the jack.
Figure 3B:
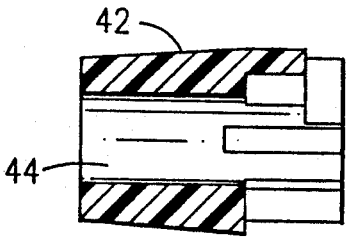
Figure 3C:
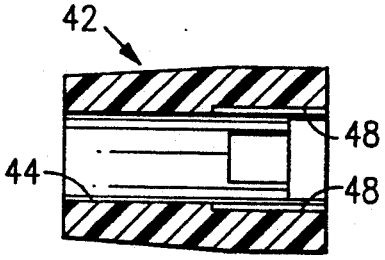

The dielectric support 42 is preferably an injection molded part and is preferably molded from a glass filled polypropylene thermoplastic material. The dielectric support 42 has a generally cylindrical shape (FIG. 3B) with an inside bore 44 running the full length thereof. This bore 44 has a diameter slightly larger than the outside diameter of the center contact 30. At the top of this cylinder are two ears 46 (See FIG. 3A) which protrude radially outward from the outside diameter of the cylinder and are equally spaced from the center line. In addition to the circular inside bore 44, there are two internal grooves 48 (See FIG. 3C) running along this bore and extending radially outward from it. These grooves are located opposite each other and sized to be slightly wider than the width of the tabs 34 on the center contact 30.

Figure 5:
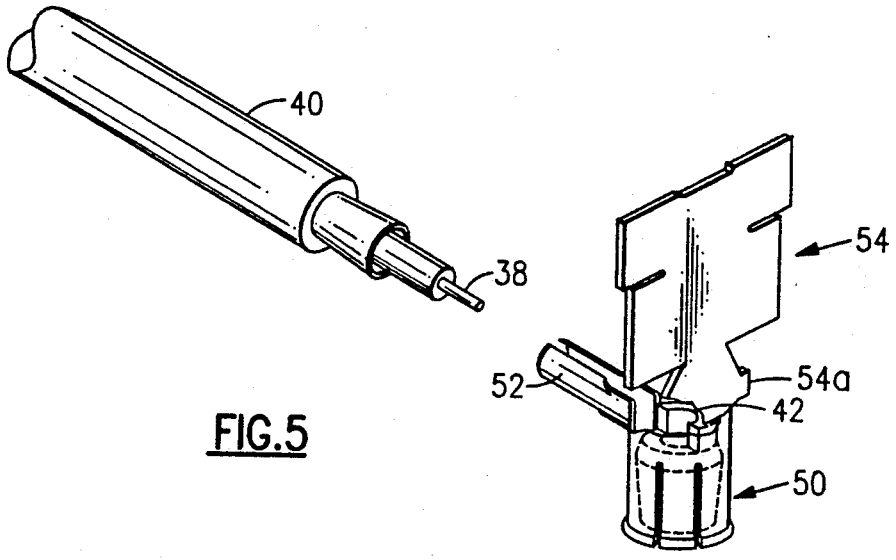
FIG. 5 is an exploded partial sectional diagramatic view of the jack before inserting the coax conductor.
Figure 4B:
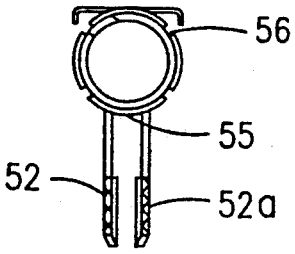
FIGS. 4A and 4B are side and end views of the outer jack conductor before assembly with the dielectric and inner conductor.
Figure 4A:
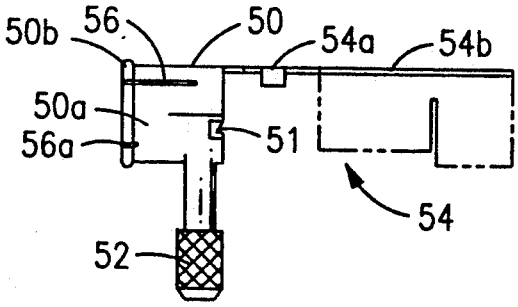

The outer housing/contact 50 is a fairly complex part which, like the center contact 30, is preferably fabricated using a progressive die stamping technique. The outer housing is preferably stamped and formed from a mill hardened beryllium copper alloy which provides high strength with good formability and requires no additional heat treating. The outer housing 50 is preferably stamped from 0.008 thick flat stock and is one continuous piece. The configuration of the outer housing can be broken into three prominent features: the main barrel 50, the cable support 52, and the cover crimp back end 54 (See FIG. 4A). The main barrel is a cylinder 50 whose inside diameter is essentially the same as the outside diameter of the top of dielectric 42. The barrel has a seam 55 on one side and two longitudinal slots 56 (See FIGS. 4A and 4B). The slots 56 and seam are equally spaced breaking the barrel into three fingers **50*a*. These fingers 50*a* are basically cantilever beams which flex radially inward during mating with the plug. There are also three additional short slots 56*a* (See FIG. 4A) which aid in forming the cylindrical barrel 50. These slots 56*a* help in making the barrel round so as to give a smooth mating and electric contact between the jack and plug. The bottom ends of the fingers 50*a* are curled at 50*b* to form a small protrusion along the width of each finger. These protrusions 50*b* fit and match the undercut groove 16*b* in the mating plug 10. The top portion of the main barrel 50 appears as a seamed ring, seen edge on, with two notches equally spaced from the ring centerline. The cable support 52 is actually formed from two arms 52*a* of material located near the top of the main barrel seam and extending perpendicular and radially outward from it. These arms 52*a* are themselves C shaped in cross section and, as they run parallel to and face one another, they form an open tube. The cover/crimp back end 54 extends upward from the main barrel 50 prior to the connector being terminated (attached) to a coaxial cable 40 (See FIG. 5). The cover/crimp back end 54 has two distinct areas. The cover is shaped like a disk 54*a* whose outside diameter is the same as the outside diameter of the barrel. The crimp back end is a U shape section 54*b*** which will form the cable attachment area (back end) of the right angle connector.

The three main parts of the jack connector 12 fit to each other and must co-locate in a very specific way. In order for the coaxial cable 40 to be terminated to the connector, the centerline of the two slots 36 located in the top of the inner contact 30 must be co-linear with the center line of the cable support 52 of the outer housing/contact 50. This is accomplished by the special features designed into the three components themselves. As mentioned, the center contact 30 is loaded into the dielectric 42 from the top of the dielectric. The tabs 34 on the center contact locate within the longitudinal grooves 48 on the dielectric inside bore. The center contact is installed into the dielectric inner diameter 44 until the bottoms of both parts are flush to each other. When the center contact 30 is fully installed the tabs 34 at the top are below the top of the dielectric 42 and the edges of the tabs 34 dig into and displace some of the plastic material in the groove 48 of the dielectric. This action mechanically captivates the center contact 30 in the dielectric 42 and prevents it from being delocated from its proper position during mating and unmating of the connector jack and plug. The dielectric/center contact combination (30,42) is then installed into the main barrel 50 of the outer housing/contact from the top end of the main barrel. The two ears 46 which were molded into the outside diameter of the dielectric will co-locate with the two notches 51 (See FIG. 4A) in the top of the main barrel ring. These features provide two functions. The relative location of the ears 46 in the dielectric and notches 51 in the main barrel ensure the proper alignment of the dielectric/center contact (30,42) combination with respect to the outer housing/contact cable support feature 50. The ears 46 will captivate the dielectric/center contact (30,42) combination when the cover/crimp back end 54 is folded down during the coaxial cable termination sequence.

The new design described in detail here has several advantages over currently available design. The design employs a high degree of DFM (Design for Manufacturability) principles especially with respect to its fool proof component co-locating features. This allows for high speed automated assembly of the connectors which reduces manufacturing costs significantly. It also reduces dimensional variations which can have an adverse effect on mechanical parameters and electrical performance. Finally, the use of beryllium copper alloy for the outer contact material with its excellent tensile yield strength provides for spring fingers which will flex without sustaining any permanent deformation over the stated life of the connector. Although mill hardened beryllium copper alloys generally are less formable than comparable phosphor bronze alloys, the beryllium copper alloy selected was specifically chosen to meet the formability requirements of the outer contact while providing the necessary strength without the need for subsequent heat treating.

We claim:

1. In a jack and plug combination wherein the plug is adapted to be surface soldered to a circuit board;

the plug having an internal cylindrical outer connector opening upwardly;

the jack having a downwardly extending cylindrical multisectioned outer connector;

the plug having an upwardly extending axial inner connector;

the jack having a cylindrical assembly of inner downwardly extending connector fingers for engaging the axial inner connector on the plug;

the improvement wherein the internal cylindrical outer connector in the plug forms a 360° contact surface and has an outwardly flared surface adjacent its upper end to receive the jack, and wherein a cylindrical insulating molded dielectric support element in the jack positions the inner connector assembly with respect to the cylindrical multisectioned outer connector, the exterior wall of the dielectric support element being tapered inwardly over most of its length, so that the cylindrical multisectioned outer connector is free of contact with the dielectric support element over most of its length to permit beam deflection over an extended length of the multisectioned connector on insertion of the jack into the plug.

2. The assembly of claim 1, wherein there is at least one groove in an inner cylindrical wall of the dielectric support near the top thereof; and at least one outwardly extending tab carried by said inner connector assembly near the top thereof for engaging said groove.

3. The combination of claim 1 wherein a pair of radially extending ears are provided adjacent the top end of the dielectric support element; and a pair of notches are provided in said cylindrical multisectioned outer connector for receiving and supporting and locating said ears.

* * * * *